US007692099B2

(12) United States Patent
Burke

(10) Patent No.: US 7,692,099 B2
(45) Date of Patent: Apr. 6, 2010

(54) FLEXIBLE AND LIGHTWEIGHT SEAT-TO-SEAT CABIN CABLE SYSTEM AND METHOD OF MANUFACTURING SAME

(75) Inventor: Paul C Burke, Lake Forest, IL (US)

(73) Assignee: Telefonix, Inc., Waukegan, IL (US)

( * ) Notice: Subject to any disclaimer, the term of this patent is extended or adjusted under 35 U.S.C. 154(b) by 0 days.

(21) Appl. No.: 11/533,292

(22) Filed: Sep. 19, 2006

(65) Prior Publication Data

US 2007/0074891 A1 Apr. 5, 2007

Related U.S. Application Data

(60) Provisional application No. 60/718,547, filed on Sep. 19, 2005.

(51) Int. Cl.
*H01B 7/00* (2006.01)

(52) U.S. Cl. ..... 174/113 R; 174/113 C

(58) Field of Classification Search ..... 174/110 R, 174/113 R, 120 R, 120 C, 36, 120 AR, 120 SR
See application file for complete search history.

(56) References Cited

U.S. PATENT DOCUMENTS

| | | | | |
|---|---|---|---|---|
| 1,977,209 A | | 10/1934 | Sargent | |
| 2,576,335 A | | 11/1951 | Fanslow | |
| 3,657,491 A | | 4/1972 | Ryder et al. | |
| 3,758,704 A | | 9/1973 | Naud | |
| 3,843,829 A | * | 10/1974 | Bridges et al. | 174/36 |
| 4,002,820 A | * | 1/1977 | Paniri et al. | 174/115 |
| 4,096,351 A | * | 6/1978 | Wargin et al. | 174/102 R |
| 4,134,953 A | | 1/1979 | Dembiak et al. | |
| 4,151,365 A | | 4/1979 | Hacker | |
| 4,284,841 A | * | 8/1981 | Tijunelis et al. | 174/103 |
| 4,384,688 A | | 5/1983 | Smith | |
| 4,538,023 A | * | 8/1985 | Brisson | 174/115 |
| 4,628,151 A | * | 12/1986 | Cardas | 174/114 R |
| 4,657,342 A | | 4/1987 | Bauer | |
| 4,675,475 A | | 6/1987 | Bortner et al. | |

(Continued)

FOREIGN PATENT DOCUMENTS

AT 171356 5/1952

(Continued)

OTHER PUBLICATIONS

C & M Corporation, Engineering Design Guide (3rd Edition), Jan. 1992, pp. 3-5, 14, 16-18.*

(Continued)

*Primary Examiner*—William H Mayo, III

(57) ABSTRACT

A cable system includes one or more bundles of conductive wire having multiple thin strands of flexible wire cable that are individually coated with an insulation layer. The bundles of conductive wire are covered by wire jacketing material and are further covered by a nylon braiding material. The cable is preferably made by coating individual wire strands with an insulating material, and then forming wire strands into wire. A thin insulating material may then be extruded over the bundles of wire strands, which are then twisted and/or shielded into cables forming a subassembly. The group of wires is formed into cables. A thin insulating material may be extruded over the cable subassemblies as a jacketing layer before the cable is cut to the desired length and braided or jacketed.

19 Claims, 10 Drawing Sheets

U.S. PATENT DOCUMENTS

| | | | | | |
|---|---|---|---|---|---|
| 4,769,906 | A | | 9/1988 | Purpura et al. | |
| 4,773,879 | A | | 9/1988 | Pauza | |
| 4,989,805 | A | | 2/1991 | Burke | |
| 4,997,992 | A | | 3/1991 | Low | |
| 5,053,583 | A | * | 10/1991 | Miller et al. | 174/36 |
| 5,094,396 | A | | 3/1992 | Burke | |
| 5,128,993 | A | | 7/1992 | Skowronski | |
| 5,235,137 | A | | 8/1993 | Jones et al. | |
| 5,268,676 | A | * | 12/1993 | Asprey et al. | 345/169 |
| 5,329,065 | A | | 7/1994 | Marney et al. | |
| 5,340,326 | A | * | 8/1994 | LeMaster | 439/207 |
| 5,491,299 | A | * | 2/1996 | Naylor et al. | 174/36 |
| 5,504,540 | A | * | 4/1996 | Shatas | 348/844 |
| 5,510,578 | A | | 4/1996 | Dunlavy | |
| 5,523,528 | A | | 6/1996 | Bese et al. | |
| 5,574,250 | A | | 11/1996 | Hardie et al. | |
| 5,659,152 | A | | 8/1997 | Horie et al. | |
| 5,939,679 | A | | 8/1999 | Olsson | |
| 6,019,304 | A | | 2/2000 | Skowronski et al. | |
| 6,114,632 | A | * | 9/2000 | Planas et al. | 174/117 R |
| 6,164,582 | A | | 12/2000 | Vara | |
| 6,169,251 | B1 | | 1/2001 | Grant et al. | |
| 6,259,031 | B1 | | 7/2001 | Totland et al. | |
| 6,300,573 | B1 | | 10/2001 | Horie et al. | |
| 6,372,988 | B1 | | 4/2002 | Burke et al. | |
| 6,386,906 | B1 | | 5/2002 | Burke | |
| 6,434,249 | B1 | | 8/2002 | Wei | |
| 6,439,491 | B1 | | 8/2002 | Liao | |
| 6,495,756 | B1 | | 12/2002 | Burke et al. | |
| 6,495,763 | B1 | * | 12/2002 | Eichmann et al. | 174/113 R |
| 6,583,360 | B1 | | 6/2003 | Yudashkin | |
| 6,626,275 | B2 | | 9/2003 | Lee | |
| 6,998,538 | B1 | * | 2/2006 | Fetterolf et al. | 174/113 R |
| 2002/0062985 | A1 | | 5/2002 | Rutledge et al. | |
| 2004/0129448 | A1 | * | 7/2004 | De Rooij | 174/126.2 |
| 2005/0121222 | A1 | * | 6/2005 | Lee | 174/113 R |

FOREIGN PATENT DOCUMENTS

| | | | |
|---|---|---|---|
| DE | 3336617 | A1 | 4/1985 |
| GB | 2316672 | B | 7/1998 |
| WO | 9809415 | A1 | 3/1998 |
| WO | 2005094290 | A2 | 10/2005 |

OTHER PUBLICATIONS

International Search Report, International Application No. PCT/US06/36564 filed on Aug. 17, 2007, 1 page.

Written Opinion of International Searching Authority International Application No. PCT/US06/36564 filed on Aug. 17, 2007, 5 pages.

* cited by examiner

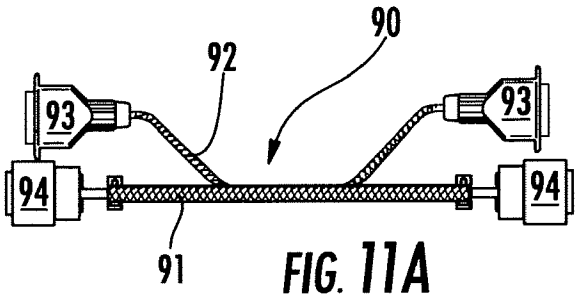
FIG. 11A
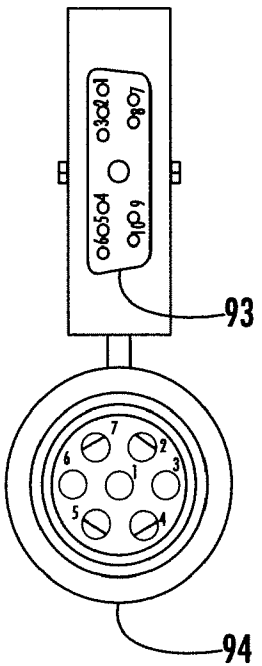
FIG. 11B
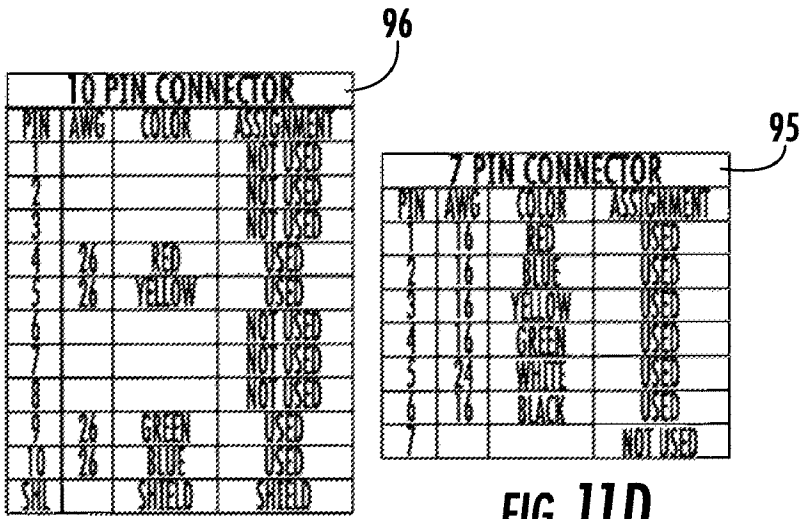
FIG. 11C
FIG. 11D
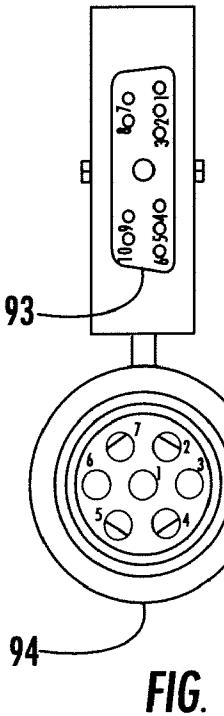
FIG. 11E

| 7 PIN CONNECTOR | | | |
|---|---|---|---|
| PIN | AWG | COLOR | ASSIGNMENT |
| 1 | 16 | RED | 12V |
| 2 | 16 | BLUE | GND |
| 3 | 16 | YELLOW | GND |
| 4 | 16 | GREEN | GND |
| 5 | 24 | WHITE | GND |
| 6 | 16 | BLACK | GND |
| 7 | | | NOT USED |

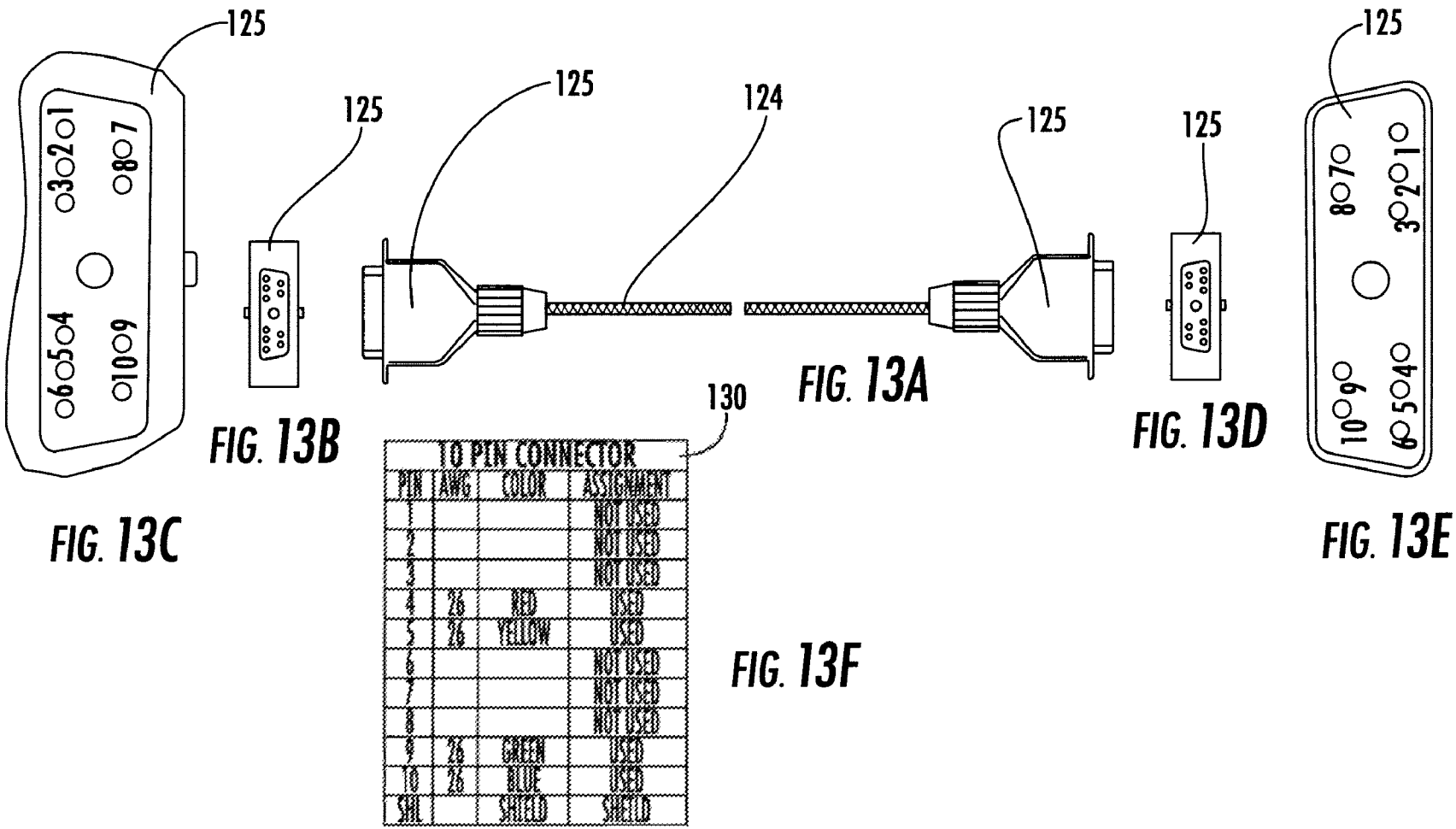
125
124
130
TO PIN CONNECTOR
PIN
WIRE
COLOR
ASSIGNMENT
1
1
1

FLEXIBLE AND LIGHTWEIGHT SEAT-TO-SEAT CABIN CABLE SYSTEM AND METHOD OF MANUFACTURING SAME

This application claims priority to U.S. provisional patent application Ser. No. 60/718,547, filed Sep. 19, 2005.

FIELD OF THE INVENTION

The present invention relates to a cable system construction and method of manufacture and in particular, to a cable system that is relatively lighter in weight and more flexible than conventional cables used in such applications as the cabin of an airplane or other vehicles, for transmitting data and power.

BACKGROUND OF THE INVENTION

Typically in buses, trains, aircraft, etc., multiple rows of seats are provided and arranged so as to provide a walkway or aisle. Rows of seats are disposed on each side and along the length of such an aisle or walkway.

The passenger seats provide a variety of electronic functions such as on aircraft where in-flight entertainment provides audio programming, video programming and communication systems such as telephone service. To convey the power and data signals needed to and from all of the passenger seats, fixed length cables or wiring harnesses are typically used to electrically couple one row of seats to another row of seats.

A change in distance between the rows of seats typically requires replacement of the fixed length cables with those having the correct length for the new configuration. This is a time-consuming and expensive operation. Moreover, the spacing between seat rows is not always consistent throughout the aircraft or vehicle.

The tight physical conditions through which such cables must be installed and/or removed in and around such rows of seats makes the use of cables that are not flexible and have a relatively high stiffness and weight per unit length undesirable for seat-to-seat cabling in such applications as commercial aircraft.

To address the difficulties of fixed length cable assemblies in vehicles such as aircraft, applicant has invented the Adjustable Length Cabling System disclosed in PCT patent application no. PCT/US2005/010289, the contents of which are herein incorporated by reference.

SUMMARY OF THE INVENTION

The lightweight, greater flexibility and decreased size of the cabin cable system of the present invention provide advantages in such applications as the cabin of commercial airlines.

Both the lower weight of the cabin cable and the ability to store extra cable (allowing a flexible length system) result in a significant weight savings for commercial airlines. This weight savings can mean lower fuel costs and can also result in the economic advantage of being able to carry more freight on that airliner.

The increased flexibility and smaller diameter of the cabin cable of the present invention as compared to traditional cables provides advantages as well. A tighter bend radii than conventional cables allows for facilitated installation in tighter spaces. As a result, space constraints in the usually overcrowded passenger cabin installations are alleviated so as to reduce the time normally needed for installation and/or replacement thereof.

Multiple signals can be carried through a single cable of the present invention so that a single assembly can handle such systems as an in-flight entertainment system, a communication system such as an in-flight phone, and/or in-seat power supply systems.

Fine stranded wire, Litz wire, or non-Litz wire may be used, which meets the voltage, temperature and flammability requirements of commercial aircraft such as FAA FAR 25.869, as well as the specifications and regulations of JAA and CAA, and is ISPSS compliant. Litz wire serves to minimize weight and maximizes mechanical flexibility—while meeting the environmental requirements associated with commercial aircraft. For example, a seventy-five inch long cabin cable of the current invention may weigh approximately 0.78 lbs., while the same length conventional, commercial aircraft seat-to-seat cabling may weigh approximately 1.16 lbs.

The outer jacket surrounding the multi-conductor cable is preferably a high temperature braided fabric such as nylon so as to: provide the desired high degree of mechanical flexibility; be lightweight; and meet the stringent environmental requirements of a commercial aircraft.

Other objects, features and advantages of the invention will be apparent from the following detailed disclosure, taken in conjunction with the accompanying sheets of drawings, wherein like reference numerals refer to like parts.

BRIEF DESCRIPTION OF THE DRAWINGS

FIG. 11A is a schematic diagram of a harness and connector assembly of the present invention.

FIGS. 11B and 11E are side elevation views of the assembly of FIG. 11A.

FIGS. 11C and 11D illustrate two charts directed to the use of a 7-pin and a 10-pin connector in the harness and connector assembly of FIG. 10A or 11A.

FIG. 13A is a schematic diagram of a data cable and connector assembly of the present invention.

FIGS. 13B and 13D are side elevation views of the assembly of FIG. 13A.

FIGS. 13C and 13E are enlarged views of the ends of 10-pin connections.

FIG. 13F illustrates a chart directed to the use of a 10-pin connector to the data cable and connector assembly.

DETAILED DESCRIPTION OF THE DRAWINGS

Figures 1A, 1B, 1C:
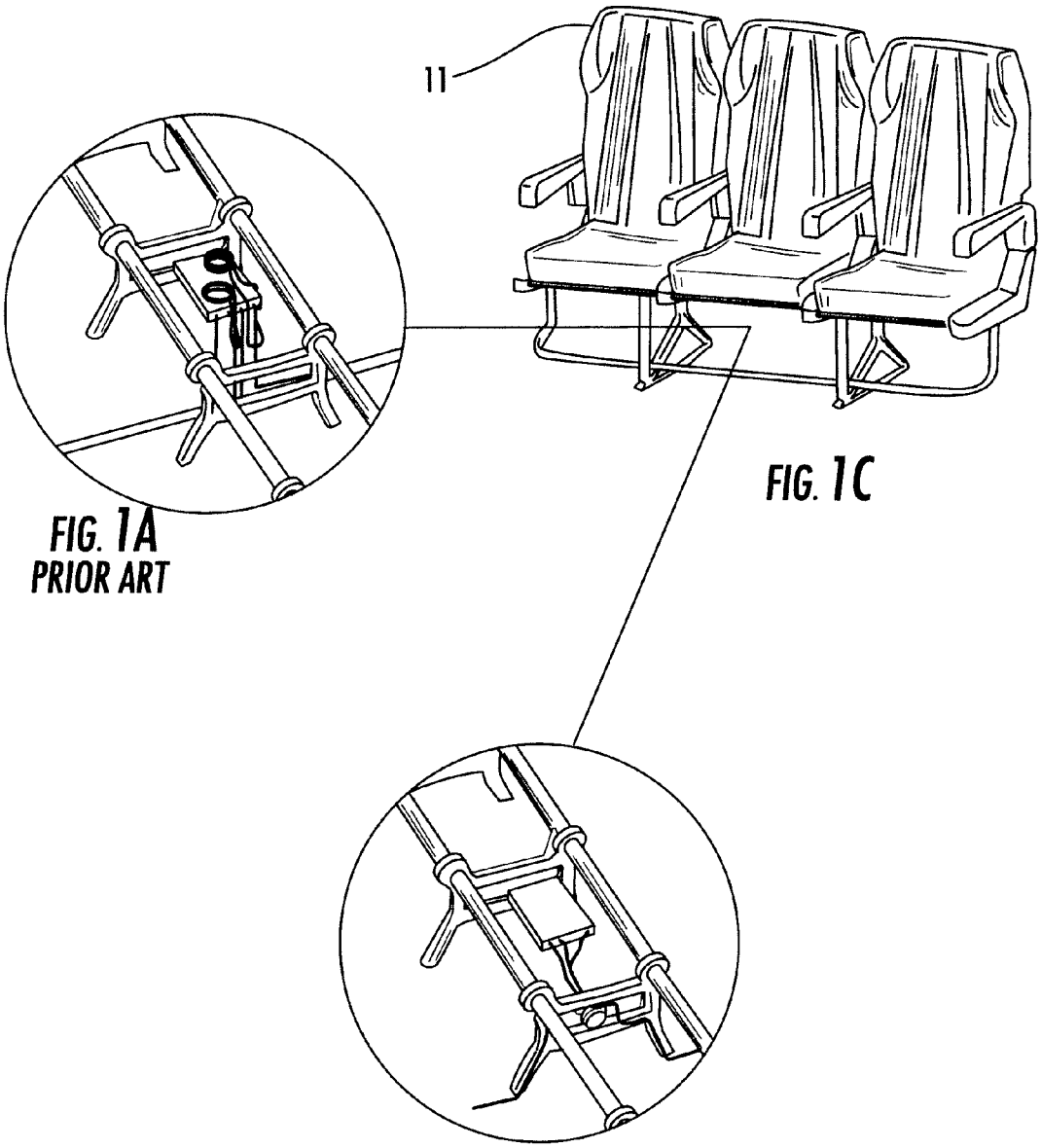
FIG. 1A PRIOR ART
FIG. 1A is a perspective partial view of a prior art cable installation.
FIG. 1B is a perspective partial view of an adjustable length cable system of the present invention
FIG. 1C illustrates a row of passenger seats.

While this invention is susceptible of embodiment in many different forms, there is shown in the drawings and will herein be described in detail several specific embodiments, with the understanding that the present disclosure is to be considered merely an exemplification of the principles of the invention and the application is limited only to the appended claims.

Typically cabin cables are installed below the seats 11 in a commercial airplane, as shown in FIGS. 1A to 1C. An adjustable length cable system of is shown as 10 in FIG. 1B. While the row of seats depicted in FIG. 1C shows three adjacent seats, any other number of seats could be used and not depart from the scope of the present invention. Furthermore, while Litz wire is shown and disclosed, it is appreciated that other types of wires, including but not limited to bare copper wires, coated copper wires or silver wires, may be used and not depart from the scope of the present invention.

Figure 2:
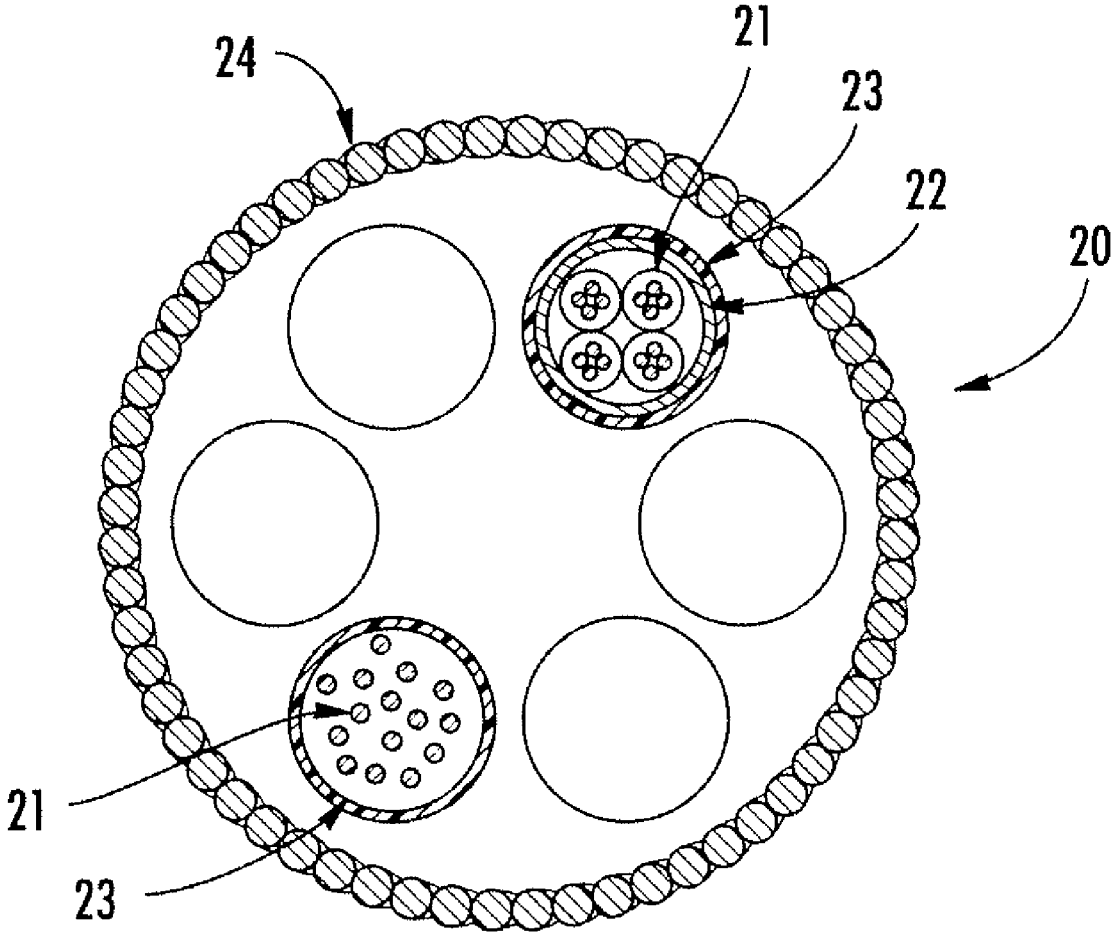
FIG. 2 is a cross-sectional view of one embodiment of a cable of the present invention.

A cross-section of one embodiment of the cabin cable 20 of the present invention is shown in FIG. 2. In one embodiment, individually insulated strands of Litz wire are used to maximize flexibility and minimize weight. Individual Litz wire bundles 21 may then be insulated with a thin insulating material such as Teflon®. One or more of the Litz wire bundles are grouped together into a cable. A thin jacketing layer such as Teflon® jacketing 23, in this example 3 mil, may be provided around this bundle. A braiding or other suitable layer of high temperature braiding material 24 is then used to surround the bundles of Litz wire 21. Some of the Litz wire bundles may be grouped together and surrounded by conductive shielding 22, such as 38 AWG tinned copper or other suitable conductive shielding. The thin jacketing layer of Teflon® may be provided around the shielding.

Figure 3:
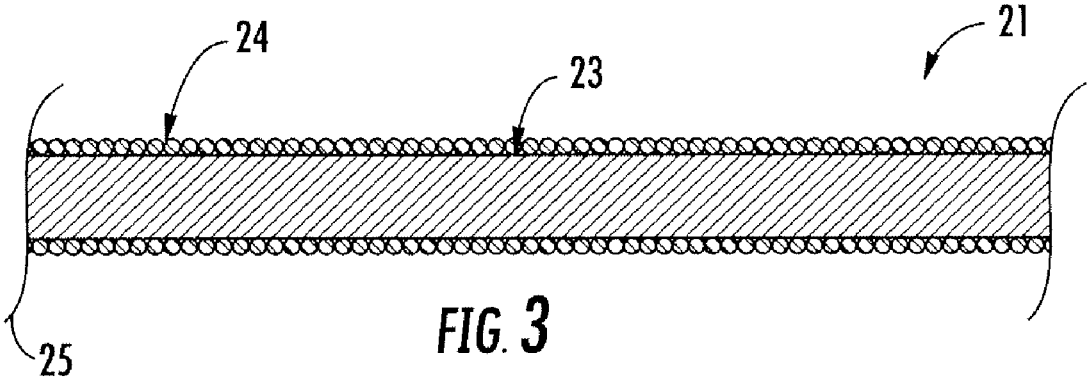
FIG. 3 is a cross-sectional view of an individual Litz wire bundle taken along its length.

An individual Litz wire bundle 21 is shown in longitudinal cross-section in FIG. 3 with twisted wire conductors 25 that may be covered by a thin layer (e.g., 3 mil layer) of Teflon® as a Teflon jacket 23, which is then covered by braiding 24.

Figure 4:
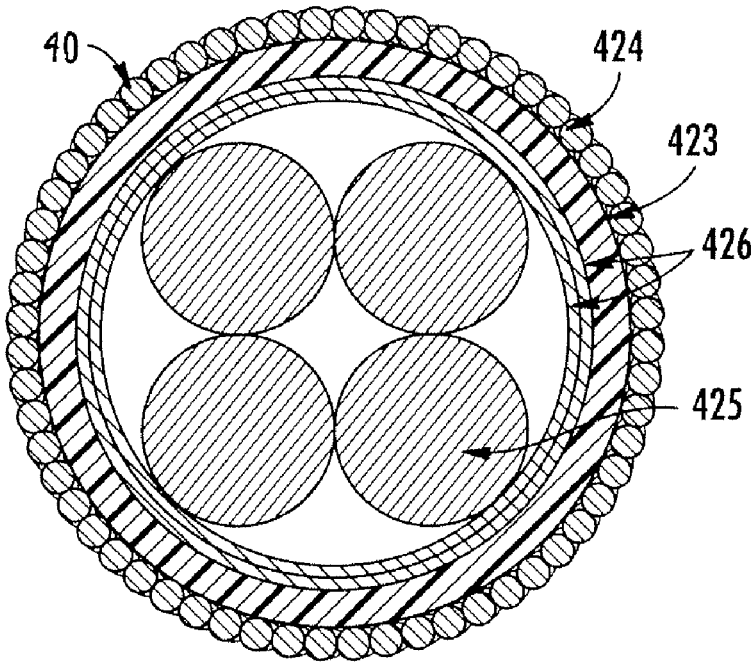
FIG. 4 is a cross-sectional view of another embodiment of a cable of the present invention.
Figure 5:
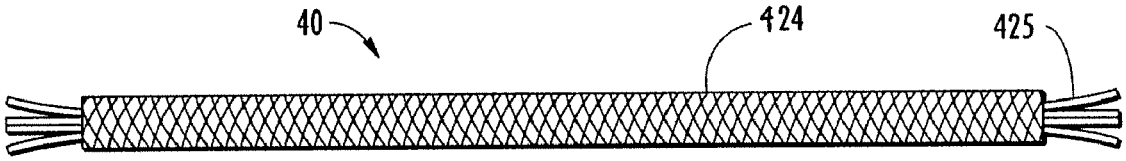
FIG. 5 is a side elevational view of the cable of FIG. 4 having four conductors.

Another embodiment of the data cable for the present invention 40 is shown in FIGS. 4 and 5. In this embodiment, four conductors 425 comprise 26AWG conductors of Litz wire, with each conductor 425 having a different color from among such colors as red, blue, yellow and green. Double shielding 426 is provided around the four conductors 425 and comprises, in one embodiment, 38AWG tinned copper with an inner shield minimum of 90% coverage and an outer shield minimum of 85% coverage. Outside the double shielding 426, a thin Teflon® jacket can be applied. Outside all of the foregoing is braid 424. The desired cable characteristics include passing FAA FAR 25.869 for flammability, a temperature limit of 200° C. and a voltage rating of 600VAC.

Figure 6:
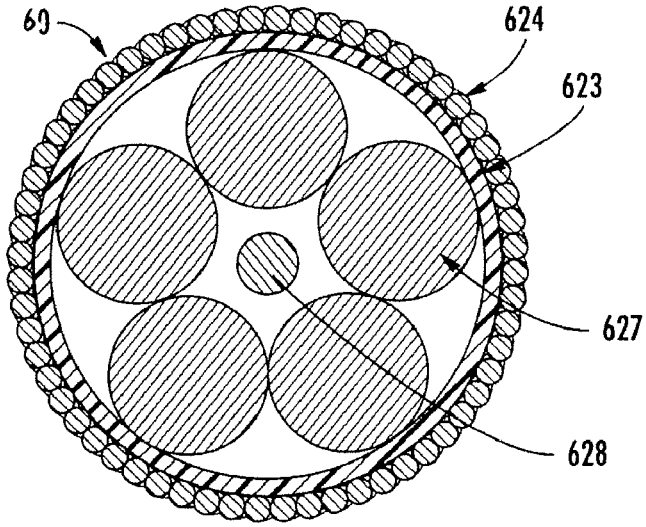
FIG. 6 is a cross-sectional view of a power cable of the present invention.
Figure 7:
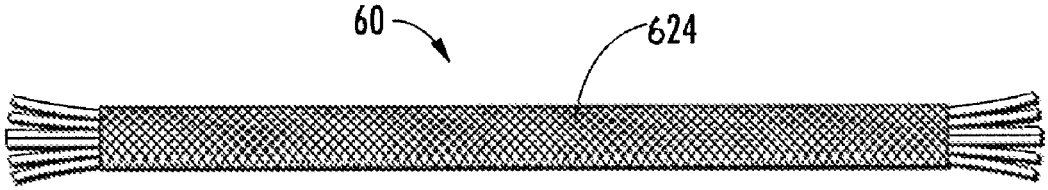
FIG. 7 is a side elevational view of the power cable of FIG. 6.

FIGS. 6 and 7 show another embodiment of a power cable 60 comprising five bundles of stranded Litz wire bundle of 16AWG conductors 627 and one Litz wire bundle of 24AWG conductors 628. In one embodiment, the single Litz wire bundle conductor 628 is preferably white, while the five Litz wire bundle conductors 627 are each preferably provided in one of the following colors: black, red; blue; yellow and green. The. A Teflon® jacket 623 of about 3 mil can be provided around the Litz wire bundled conductors 627 and 628. Around all of the foregoing is the braid 624.

Figure 8:
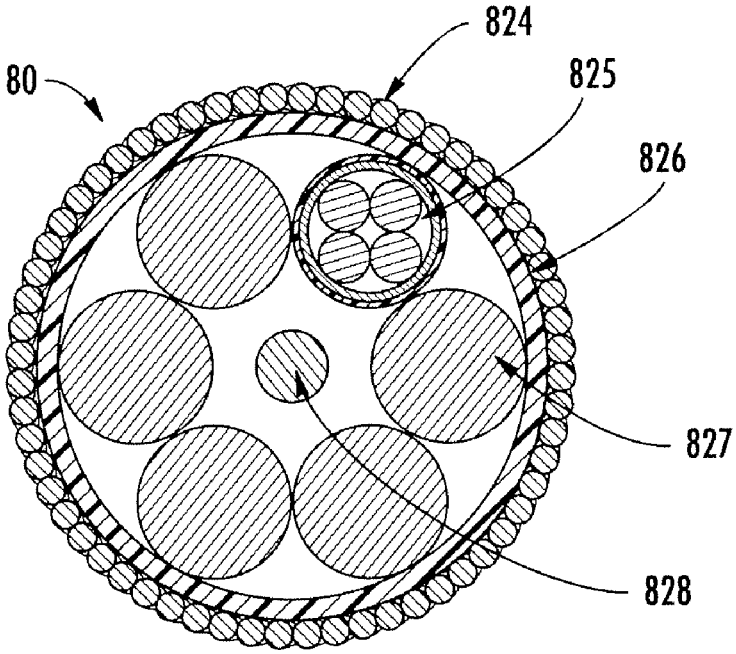
FIG. 8 is a cross-sectional view of a harness cable of the present invention.
Figure 9:
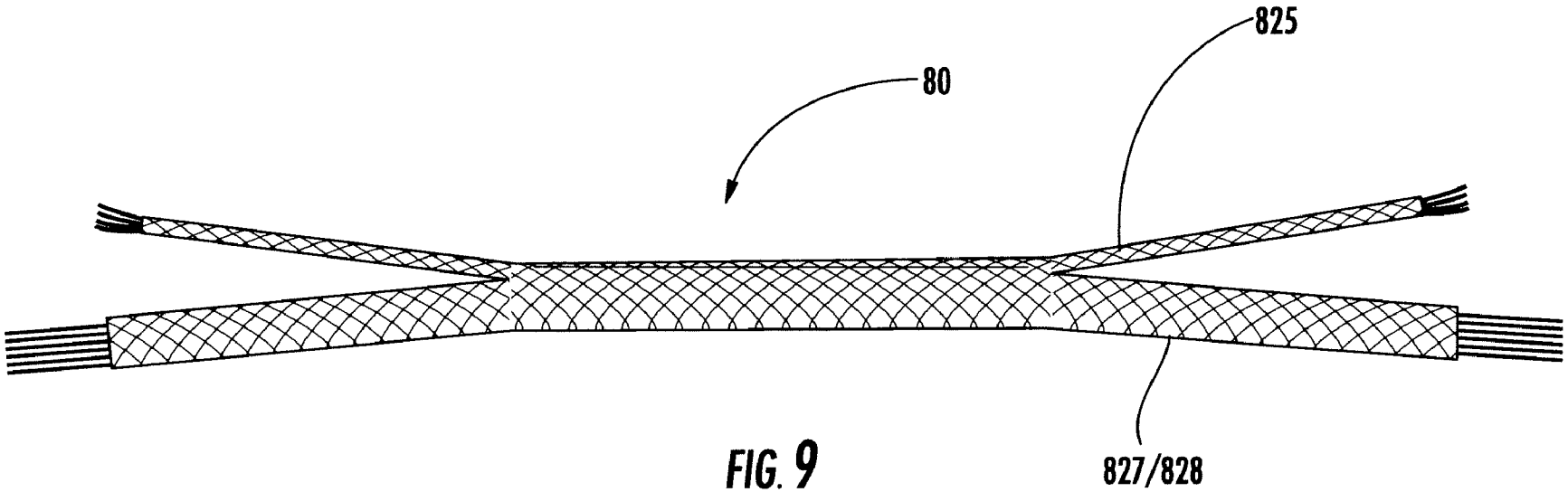
FIG. 9 is a side elevational view of the harness cable of FIG. 8 wherein the data cable is separated from the power cable.

An embodiment of a seat-to-seat power and data harness cable 80 is shown in FIGS. 8 and 9 having a 26AWG, 100 Ohm Litz wire bundle data cable 825, together with five 16AWG stranded Litz wire conductors 827 and one 24AWG Litz wire conductor 24. These six Litz wire bundles 827 and 828 can be bundled by Teflon® jacket 826 such as, but not limited to, a 3 mil Teflon® layer. Braid 824 surrounds Teflon® jacket 826 and bundled conductors 827 and 828. Cabling is preferably done in a planetary manner, so as to be as round as possible.

The voltage reading as for the other cables described herein is preferably 600 VAC. The temperature rating, as with the other cables, is at least 200° C. The flammability standard, as with all the cables described herein, is that it must pass FAA FAR 25.869.

As shown in FIG. 9, Data Cable bundle 825 may be separable from power cable portion 827/828 in Cable 80.

Figures 10A, 10B, 10C:
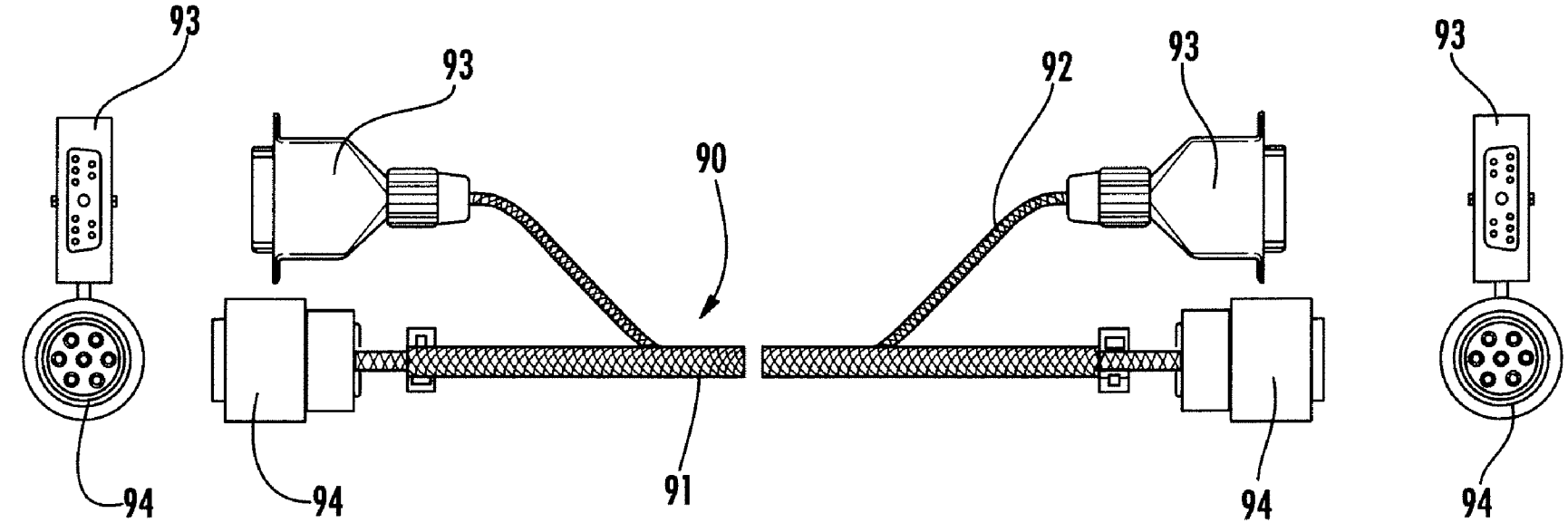
FIG. 10A is a schematic diagram of a harness and connector assembly of the present invention.
FIGS. 10B and 10C are side elevation views of the assembly of FIG. 10A.

Harness and connector assembly 90 is shown in FIGS. 10 and 11. Data portion 92 ends in connectors 93 while power portion 91 ends in connectors 94. Referring to FIG. 11C, the chart 96 for a 10-pin connector 93 shows how the pins shown and numerically labeled in FIGS. 11B and 11E may be assigned. The chart 95 for a 7-pin connector 94 shown in FIG. 11D shows how those pins may be assigned.

Figures 12A, 12B, 12C, 12D, 12E, 12F:
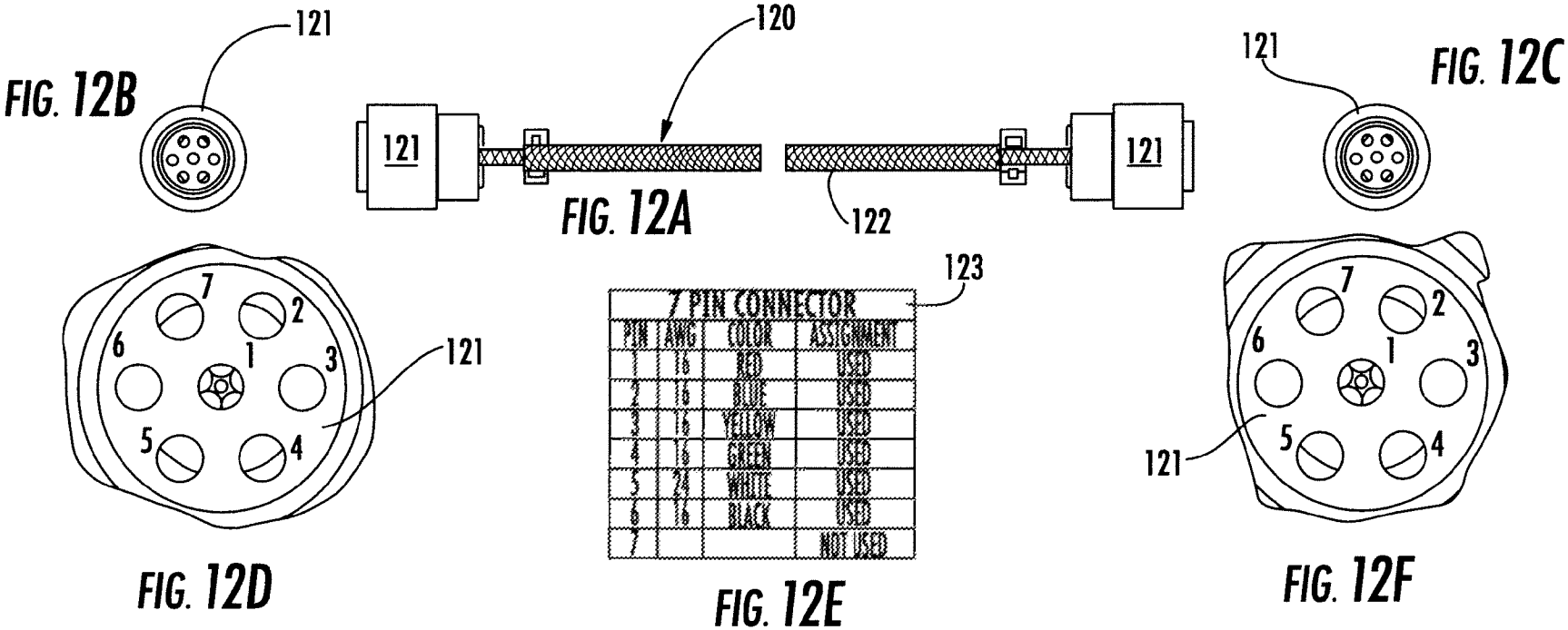
FIG. 12A is a schematic diagram of a power cable and connector assembly of the present invention.
FIGS. 12B and 12C are side elevation views of the assembly of FIG. 12A.
FIGS. 12D and 12F are enlarged views of the 7-pin connection of one embodiment of a power cable.
FIG. 12E illustrates a chart directed to the use of a 7-pin connection in the power cable and connector assembly.

FIGS. 12 and 13 show a power cable and connector assembly 120 and a data cable and connector assembly 124 respectively. In the embodiment shown, power cable 122 ends in 7-pin connectors 121. Chart 123 of FIG. 12 shows how the pins of 7-pin connector 121 shown and numerically labeled in the enlarged images shown in FIGS. 12D and 12F are used. With respect to data cable 124, chart 130 shows how the pins of 10-pin connector 125 shown and numerically labeled in the enlarged images of FIGS. 13C and 13E may be assigned.

The cabin cable of the present invention can be manufactured in the following preferred process. Individual wire strands are formed from the multi-stranded Litz wire or other copper, copper alloy or other comparable conductive wire. Such individual wire strands are then coated with insulating material, such as wire coating enamel or resin insulation. These multiple wire strands are formed into wire bundles of the desired size by a planetary cable wrapping system or other suitable cable-forming machinery. A very thin insulating material such as wire coating enamel or resin is then extruded over the bundles of wire strands. The bundles of wire strands are then twisted and/or shielded into cable assemblies as required. Though optional, a very thin insulating material can also be extruded over these cable sub-assemblies. The groups of wires are then formed into cable bundles. As an option, a very thin insulating material such as for example, a 3 mil layer of Teflon® jacketing material can be extruded over the finished cable subassemblies.

The cable is then measured and cut to length and prepared for braiding or other final outer jacket material. The ends of the individual wires are then prepared for connectorization and the individual wires are connectorized with terminals. The terminals are placed into the appropriate locations in the connector housings. The connector backshells and/or strain reliefs are then completed and the cable markings and codes are then added.

Although certain example methods, apparatus and methods of manufacture are described herein, the scope of coverage of this patent is not limited thereto. On the contrary, this patent covers all methods, apparatus and articles of manufacture fairly falling within the scope of the appended claims either literally or under the doctrine of equivalents.

I claim:

1. A light-weight, flexible power and data cable for the interior of a commercial aircraft comprising:

one or more bundles of conductive wire comprising multiple thin strands of flexible wire cable;

each of the strands of the conductive wires being individually coated with an insulation layer to maximize flexibility and minimize weight;

said bundles of conductive wire being covered by a layer of wire jacketing material; and said one or more bundles of cable being further covered by a nylon braiding material, so as to provide a tight bend radii for facilitated installation in tight spaces.

2. The cable of claim 1 wherein said insulation layer comprises a Teflon coat.

3. The cable of claim 1 wherein said jacketing material comprises a Teflon coat.

4. The cable of claim 1 wherein said conductive wires are color coated.

5. The cable of claim 1 wherein said conductive wires comprise Litz wire.

6. The cable of claim 1 further comprising a conductive shield surrounding at least one of said one or more bundles.

7. The cable of claim 1 wherein said cable comprises a power cable comprising five bundles of 16AWG conductors and one bundle of 24AWG conductors.

8. The cable of claim 7 wherein said 16AWG conductors comprise different colors selected from the set of black, red, blue, yellow and green.

9. The cable of claim 8 wherein said 24AWG conductor is white.

10. The cable of claim 1 wherein said conductive wires are selected from the group consisting of bare copper wires, coated copper wires and silver wires.

11. The cable of claim 1 wherein said cable comprises a bundle data cable, five stranded wire conductors and one 24AWG wire conductor.

12. The cable of claim 1 wherein said bundles of conductive wires comprises a data cable bundle and a power cable bundle.

13. The cable of claim 12 wherein said data cable bundle is separable from said power cable bundle.

14. A method for manufacturing a light-weight, flexible power and data cable for the interior of a commercial aircraft comprising:

forming individual wire strands from flexible wire cable;

coating said individual wire strands with insulating material to maximize flexibility and minimize weight;

forming multiple wire strands into wire of desired sizes;

extruding very thin insulating material over bundles of wire strands;

twisting the wires into cable subassemblies;

forming groups of wires into cables;

coating the cables with a jacketing layer;

measuring and cutting the cable to length and preparing for braiding or other final outer jacket material; and covering prepared cables with a nylon braiding material so as to provide a tight bend radii for facilitated installation in tight spaces.

15. The method of claim 14 which further comprises the steps of:

preparing ends of individual wires for connectorization;

connectorizing individual wires with terminals; and placing terminals into appropriate locations in connector housings.

16. The method of claim 14 wherein said jacketing layer comprises Teflon.

17. The method of claim 14 wherein said insulating material comprises Teflon.

18. The method of claim 14 wherein said cables comprise a power cable.

19. The method of claim 14 wherein said cable comprises a power and data harness cable.

* * * * *